US012788141B2

(12) United States Patent
Lyu et al.

(10) Patent No.: US 12,788,141 B2
(45) Date of Patent: Nov. 10, 2026

(54) HIGHLY STABLE ASSEMBLED CABINET

(71) Applicant: Jun Lyu, Hangzhou (CN)

(72) Inventors: Jun Lyu, Hangzhou (CN); Jie Li, Hangzhou (CN)

(73) Assignee: Jun Lyu, Hangzhou (CN)

( * ) Notice: Subject to any disclaimer, the term of this patent is extended or adjusted under 35 U.S.C. 154(b) by 144 days.

(21) Appl. No.: 18/663,078

(22) Filed: May 14, 2024

(65) Prior Publication Data

US 2025/0234993 A1 Jul. 24, 2025

(30) Foreign Application Priority Data

Jan. 19, 2024 (CN) ..... 202420133948.3

(51) Int. Cl.
*A47B 47/00* (2006.01)
*A47B 87/02* (2006.01)

(52) U.S. Cl.
CPC ..... *A47B 47/0016* (2013.01); *A47B 47/0091* (2013.01); *A47B 87/0292* (2013.01)

(58) Field of Classification Search
CPC ..... A47B 47/0016; A47B 47/0091; A47B 87/0292
USPC ..... 312/111
See application file for complete search history.

(56) References Cited

U.S. PATENT DOCUMENTS 3,913,289 A * 10/1975 Recker ..... E04B 1/1903 211/188
4,169,639 A * 10/1979 Zola ..... A47B 47/04 297/440.13
5,466,057 A * 11/1995 Blankenburg ..... A47B 87/005 312/111
5,473,845 A * 12/1995 Livingston ..... E04H 1/1205 52/79.9
D455,292 S * 4/2002 Hardy ..... D6/675
6,557,955 B2 * 5/2003 Saravis ..... A47B 47/0033 403/381
D506,613 S * 6/2005 Gusdorf ..... D6/675
7,866,769 B2 * 1/2011 Ahlgrim ..... F16B 12/46 312/265.5
7,963,404 B2 * 6/2011 Shang ..... A47F 7/08 211/36
8,051,535 B2 * 11/2011 Cheng ..... A47B 47/0033 16/320
8,955,928 B2 * 2/2015 Cheng ..... A47B 47/0033 312/265.2
9,089,212 B2 * 7/2015 Chang ..... A47B 47/0016
9,226,576 B2 * 1/2016 Shang ..... A47B 47/0033
(Continued)

*Primary Examiner* — Daniel J Troy
*Assistant Examiner* — Timothy M Ayres
(74) *Attorney, Agent, or Firm* — IPRTOP LLC

(57) ABSTRACT

The present disclosure provides an assembled cabinet with multiple storage units. Each storage unit includes multiple panels and connectors interconnected to form an inner space and an opening. Each of the panels includes a panel frame and a panel sheet that covers the panel frame, with panel corners of the panel frame not being covered by the panel sheet. Each of the connectors has multiple panel corners corresponding to panel corners, and adjacent connector slots are oriented perpendicularly to each other. Further, the storage unit includes corner braces each being inserted into a corresponding connector located around the opening of the storage unit, and the corner braces are installed into available connector slots of the corresponding connectors.

14 Claims, 8 Drawing Sheets

(56) References Cited

U.S. PATENT DOCUMENTS

| | | | | |
|---|---|---|---|---|
| 9,445,666 | B2 * | 9/2016 | Chang | A47B 55/02 |
| 11,452,372 | B2 * | 9/2022 | Wei | A47F 3/147 |
| 2004/0131416 | A1 * | 7/2004 | Wu | A47B 47/0033 403/170 |
| 2009/0020669 | A1 * | 1/2009 | Wang | A47B 43/04 248/220.1 |
| 2009/0166356 | A1 * | 7/2009 | Tsai | A47F 3/12 220/4.01 |
| 2013/0292351 | A1 * | 11/2013 | Wyatt | A47B 47/042 211/188 |
| 2016/0066688 | A1 * | 3/2016 | Yu | A47B 47/0075 312/265.5 |

* cited by examiner

Note: Reference numeral 50 has been added to indicate the "mount frame".

HIGHLY STABLE ASSEMBLED CABINET

CROSS REFERENCE TO RELATED APPLICATION

This is a U.S. non-provisional application, which claims priority of a Chinese Patent Application No. CN 202420133948.3, entitled "A Highly Stable Assembled Cabinet", filed with CNIPA on Jan. 19, 2024. The contents of the above application are hereby incorporated by reference for all purposes.

FIELD OF TECHNOLOGY

The present disclosure belongs to the field of storage furniture, particularly relating to an assembled cabinet with strong stability.

BACKGROUND

Assembled cabinets composed of panels and connectors as assembly units are widely used due to their ease of disassembly and mobility. However, the connectors used in most existing assembled cabinets have a simple structure, merely fixing the frame of the panel unit within the connector's mounting slot, which is an open structure. This can lead to instability and wobbling under lateral or longitudinal forces. Particularly, for assembled cabinets with doors at the front that require frequent opening and closing, this can easily lead to structural instability and even disassembly of the assembled cabinet.

The present disclosure provides an assembled cabinet with multiple storage units. Each storage unit includes multiple panels and connectors interconnected to form an inner space and an opening. Each of the panels includes a panel frame and a panel sheet that covers the panel frame, with panel corners of the panel frame not being covered by the panel sheet. Each of the connectors has multiple panel corners corresponding to panel corners, and adjacent connector slots are oriented perpendicularly to each other. Further, the storage unit includes corner braces each being inserted into a corresponding connector located around the opening of the storage unit, and the corner braces are installed into available connector slots of the corresponding connectors.

DETAILED DESCRIPTION

The following detailed description of the embodiments and drawings are used to illustrate principles of the present application exemplarily, instead of limiting the scope of the present application. That is, the present application is not limited to the described embodiments.

In the description of the application, it should be noted that, unless otherwise stated, "a plurality of" means two or more; the terms "top", "bottom", "left", "right", "inside", and "outside" used to indicate orientation or position relationships are only for purpose of facilitating the description of the application and simplifying the description, and do not indicate or imply that a device or element referred to must have a specific orientation, be constructed and operated in a specific orientation, and therefore cannot be understood as limitations to the application. In addition, the terms "first", "second", "third", etc. are only used for descriptive purposes, and cannot be understood as indicating or implying relative importance. "Vertical" is not strictly vertical, but within an allowable range of error. "Parallel" is not strictly parallel, but within an allowable range of error.

In the description of the application, it should also be noted that, unless otherwise explicitly stated and defined, the terms "installation", "interconnection", and "connection" should be understood in a broad sense, for example, it may be a fixed connection or a detachable connection, an integral connection; it may be a direct connection or an indirect connection through an intermediate medium. For those of ordinary skills in the art, specific meanings of the above-mentioned terms in this application may be understood according to specific circumstances.

Moreover, terms "comprising", "including", or any other variation thereof, are intended to cover non-exclusive inclusion, such that a process, method, article or device that include a series of elements may not include only those elements but may include other elements not explicitly listed or inherent to such process, method, article or device. Without more constraints, elements preceded by "include" do not preclude additional identical elements existing in the process, method, article or device that include the elements.

Figure 1:
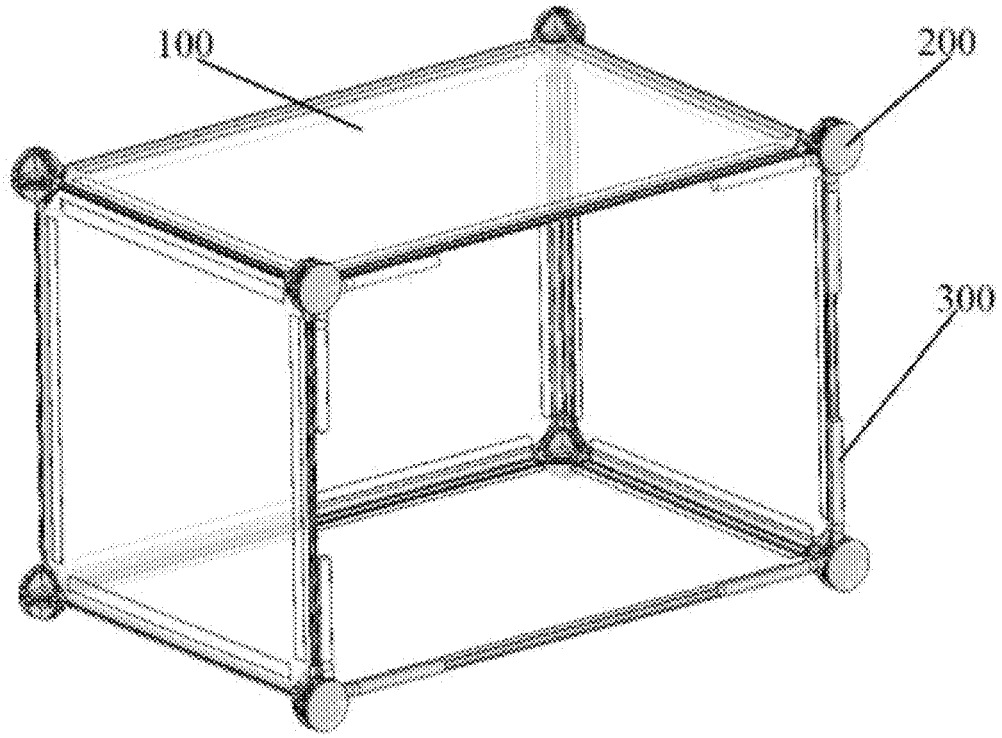
FIG. 1 shows a storage unit configured for constructing an assembled cabinet with reinforced stability structure.

FIG. 1 shows a storage unit configured for constructing an assembled cabinet with reinforced stability structure, according to certain embodiments of the present disclosure. FIG. 1 shows a single storage unit, which may be manually or factory assembled using, without limiting, multiple panels 100, connectors 200, and corner braces 300. The panels 100, connectors 200, and corner braces 300 are designed according to uniformed measurements, so that the parts may be interchangeable and can be fitted into each other easily.

As shown in FIG. 1, five panels may be used to form the top, bottom, left, right, and back sides of the storage unit, leaving the front of the storage unit open for easy access. Eight connectors 200 are used to connect the five panels 100 together. In addition, four corner braces 300 are installed in the four corners of the front of the storage unit. And each of the corner braces 300 has L-shaped reinforcement rods that can provide additional support to the structure of the storage unit.

In some embodiments, multiple single storage units may then be connected and arranged in rows and columns to create a customized assembled cabinet according to user needs. The resulting assembled cabinet, or cube cabinet, may be construed by sharing panels 100, connectors 200, and/or corner braces 300. For example, two adjacent storage units may share a single panel 100, and up to eight adjacent panels 100 may share a single connector 200. Additional components, such as doors, frames, braces, and/or other reinforcement structures, may be added into the assembled cabinet to provide different functionalities.

Figure 2:
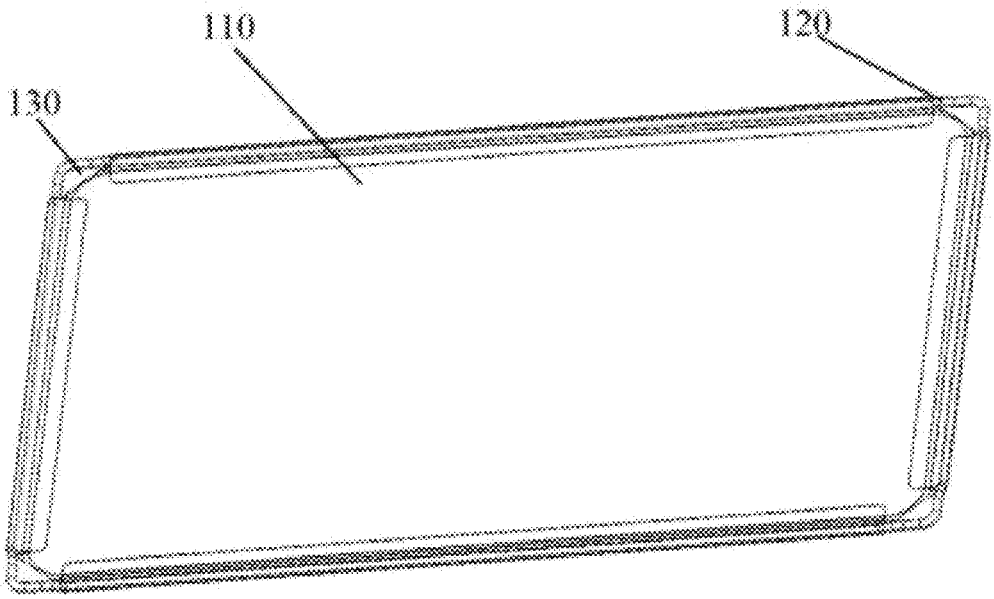
FIG. 2 shows a panel that can be used to construct a storage unit or an assembled cabinet.

FIG. 2 shows a panel 100 that can be used to construct a storage unit or an assembled cabinet, according to certain embodiments of the present disclosure. In FIG. 2, the panel 100 includes a panel frame 110, and a panel sheet 120 that covers the panel frame 110 and wraps around the four edges of the panel frame 110, leaving four corners of the panel 100 exposes as panel corners 130. The panel sheet 120 may be made of rigid or elastic materials such as plastic, fabric, or metal mesh that can provide coverage and strength to the panel 100. Each panel corner 130 may allow a connector to be installed onto.

Figure 3:
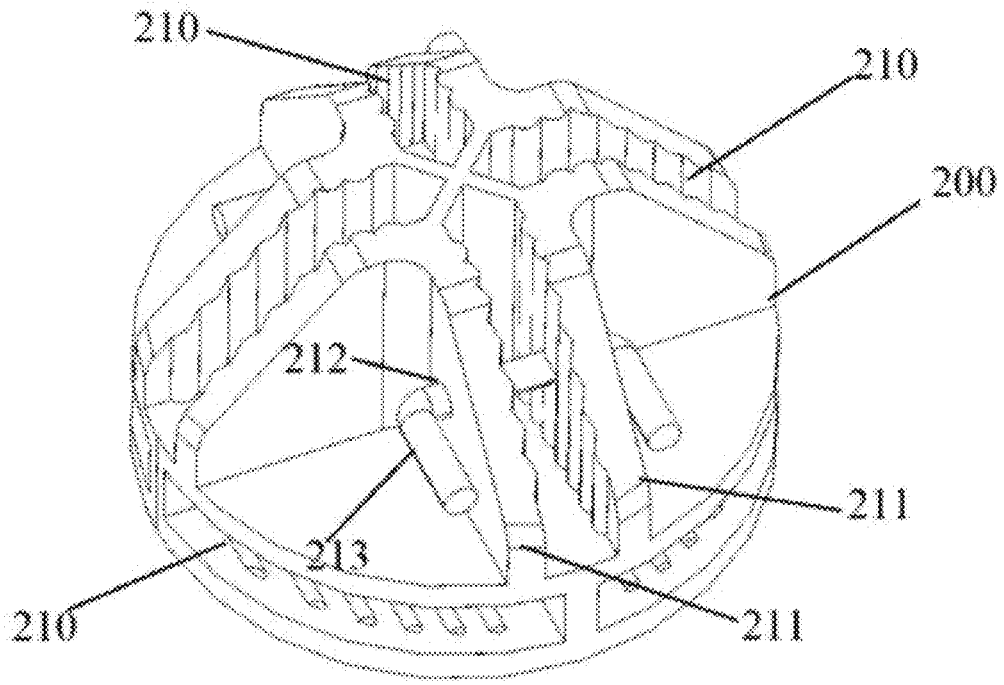
FIG. 3 shows a connector configured to be used for connecting one or more panels.

FIG. 3 shows a connector configured to be used for connecting one or more panels, according to certain embodiments of the present disclosure. The connector 200 may be configured with multiple connector slots 210 each of which can be fitted with a panel corner 130 of the panel 100. Specifically, the connector 200 may have up to four horizontal bottom slots 210 located at the bottom part of the connector 200, and up to four vertical slots 210 located at the top part of the connector 200. Each connector slot 210 may be formed by two slot walls 211 parallel to each other. When a panel corner is inserted into a connector slot 210, its two slot walls 211 may tightly hold the panel corner from two sides without letting the panel corner easily slipped out of the connector slot 210.

In some embodiments, the slot walls 211 of a connector slot 210 may have matching locking holes 212 for locking an inserted panel frame, panel corner, or enhancement rod of a corner brace. Once the panel frame 110 (or panel corner) is inserted into the connector slot 210, a locking bar 213 is threaded through the locking holes 212 to prevent the panel frame's disengagement from the connector slot 210, thereby enhancing the locking effect. The locking bar 213 may adopt various shapes such as straight, U-shaped, or L-shaped for effectuate locking. Additionally, the locking bar 213 may be made of a rigid (e.g., metal) or elastic material, allowing it to be inserted into and passed through the locking holes 212 and secured to the slot plate 211 with bending.

In some embodiments, each connector slot 210 may be mutually perpendicular to the adjacent slots 210 in the X, Y, and/or Z-axis directions. Depending on the position of the connector 200 within the assembled cabinet, the number of connector slots 210 holding a panel corner 130 of a panel 100 can vary accordingly. For example, for a connector 200 that is located at the top, bottom or the back sides of the assembled cabinet, the number of connector slots 210 that are installed with the corresponding panel corners 130 may be two, three, or four. Up to four panel corners 130 (corresponding to four panels 100) may be horizontally inserted into the four "bottom" connector slots 210 of the connector 200, and another four panel corners 130 (corresponding to another four panels 100) may be vertically inserted to four "vertical" connector slots 210 of the connector. Therefore, a single connector may be configured to connect from two to eight panels together, thereby preventing these panels from swaying or detached under external force, which in turns enhances the assembled cabinet's strength.

Figure 4:
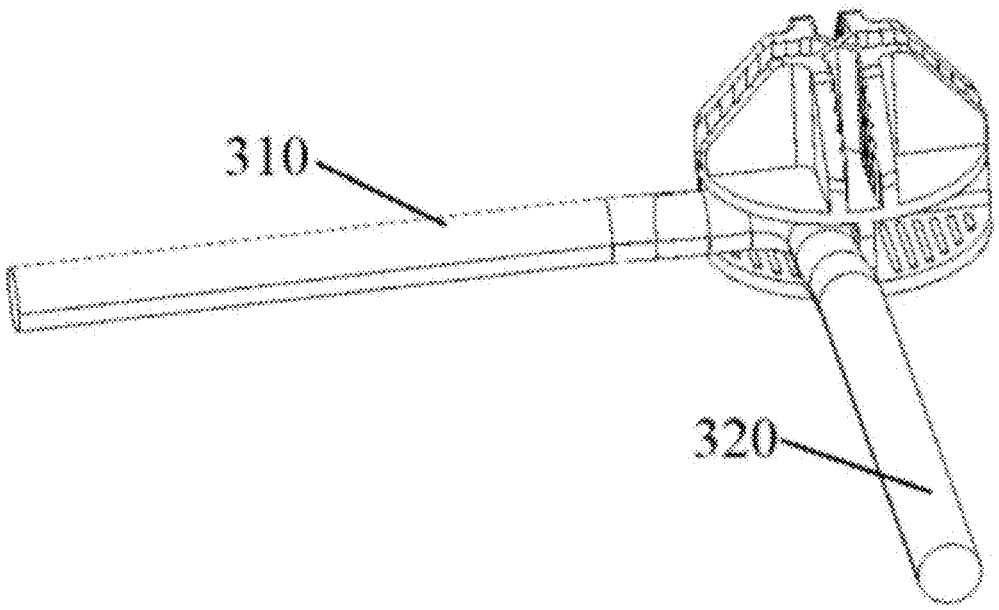
FIG. 4 shows a L-shape corner brace.

FIG. 4 shows a L-shape corner brace, according to certain embodiments of the present disclosure. A corner brace 300 may be inserted into a connector slot of a connector 200. The corner brace 300 may have a horizontally oriented reinforcement rod 310 and/or a vertically oriented reinforcement rod 320. When the assembled cabinet faces external forces, both the horizontal reinforcement rod 310 and vertical reinforcement rod 320 at least partially make contact with the panel 100, its frame, and/or its sheet. This contact provides supports to counteract the external forces, preventing the panels adjacent to the horizontal reinforcement rod 310 or the vertical reinforcement rod 320 from detaching from the connector.

In some embodiments, as shown in FIG. 4, the corner brace 300 may have its horizontal reinforcement rod 310 and vertical reinforcement rod 320 intersecting into an L-shape, forming a corner which is similar to a panel corner of a panel. The corner may be inserted into a connector slot of a connector. The corner brace 300 in FIG. 4 may also be referred to as a L-shaped corner brace 300, and the storage unit in FIG. 1 may have four L-shaped corner braces 300 installed in the four corners around the front opening of the storage unit.

Figure 5:
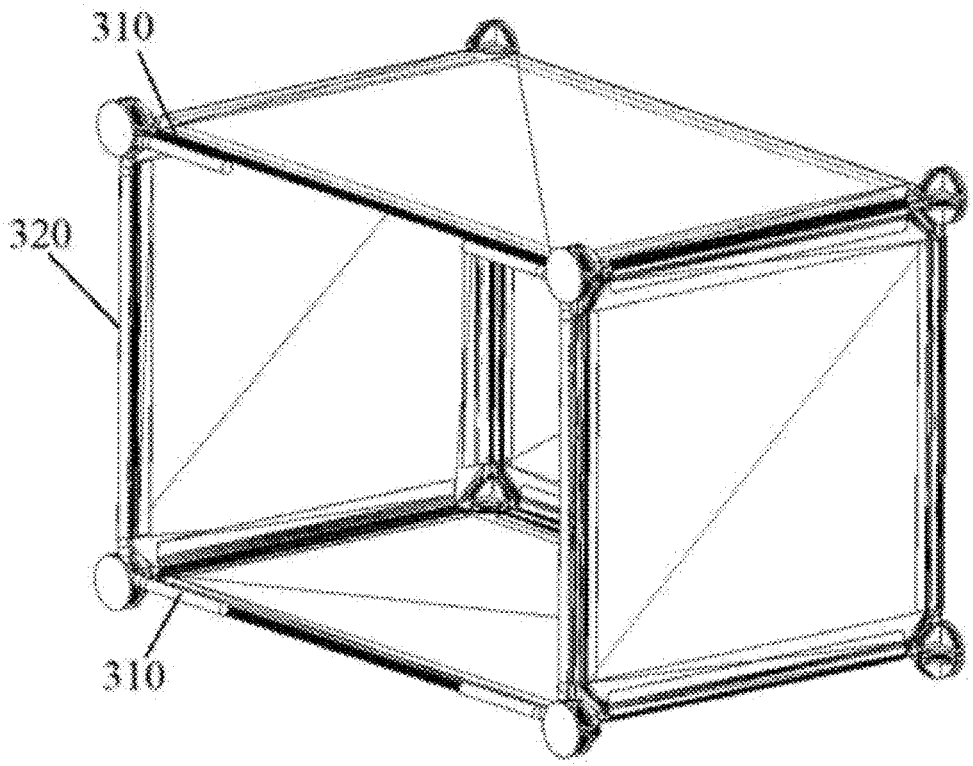
FIG. 5 shows a U-shaped corner brace.

FIG. 5 shows a U-shaped corner brace, according to certain embodiments of the present disclosure. In FIG. 5, one or two corner braces are installed into the two or four corners around the front opening of the storage unit. Each corner brace may have two horizontal reinforcement rods 310 and one vertical reinforcement rod 320, intersecting into a U-shape. The vertical reinforcement rod 320 may have a length that is substantially equal the height/width of the storage unit, and the length of the two horizontal reinforcement rods 310 may be equal to or less than half of the length of the vertical reinforcement rods 320. The reinforcement rods may be made of plastic, wood, metal, or any solid material that can withstand external forces. The reinforcement rods may also be a solid or hollow tube.

In some embodiments, the U-shaped corner brace can have two corners that can be inserted into two connector slots 210 of two adjacent connectors. The two U-shaped corner braces in FIG. 5 are installed on the left and right of the front opening of the storage unit. Alternatively, the two U-shaped corner braces may be installed on the top and bottom of the front opening of the storage unit. Thus, the U-shaped corner brace is configured to be installed into two connectors, which may add additional structure supports between these two connectors.

In some embodiments, corner braces 300 may be installed onto the connectors that are located on the edges of an assembled cabinet. Similar to the connectors located around an opening of the storage unit or the assembled cabinet, connectors located on the edges of the assembled cabinet may have some of their connector slots available for adding corner braces 300. For example, the connector located at the top-right-back may connect three panels (e.g., a top panel, a right panel, and a back panel), meaning five of its eight connector slots are opening and available. Thus, a L-shaped corner brace may be added to one of the five connector slots for enhanced supports. Alternatively, a U-shaped corner brace may be added to connect the connector at the top-right-back corner with another horizontally-adjacent or vertically adjacent connector.

In some embodiments, the L-shaped corner brace or the U-shaped corner brace may have one of its reinforcement rods shortened, so that the shortened rod either would not extend out of the two walls of a connector slot 210, or the portion of the rod that extends out of the two walls of the connector slot 210 would bend toward a direction that is different from the rod's original direction. In other words, when this shortened L-shaped corner brace or U-shaped corner brace is inserted into the connector slots 210, their shortened rod would not extend out of the connector slot 210 and disturb the balance of the assembled cabinet. Further, the corner brace with bended rod may be installed at the bottom of the cabinet to serve as supporting legs.

Figure 13:
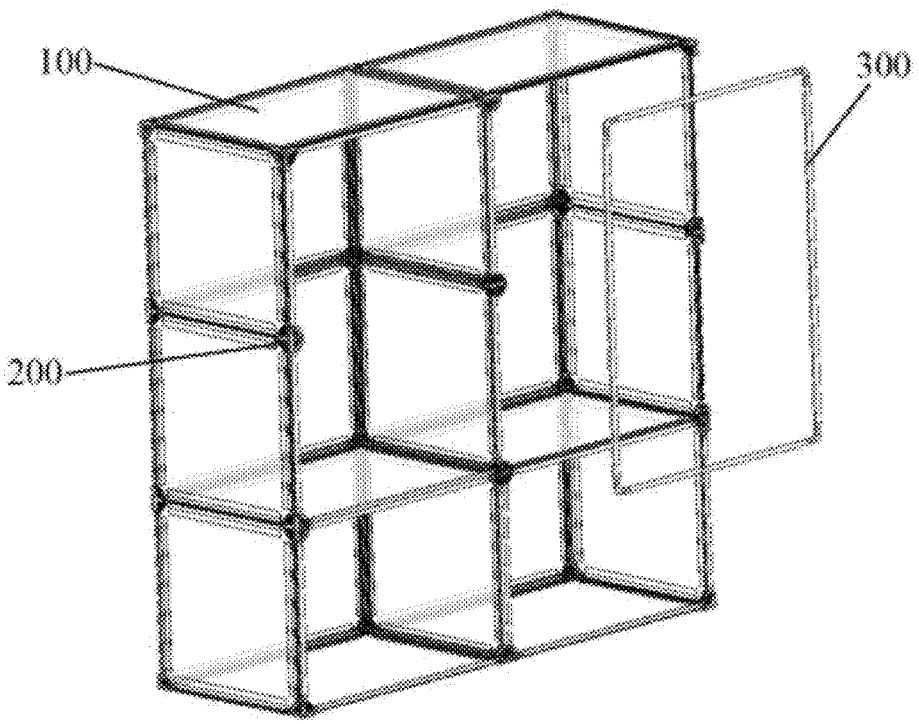
FIG. 13 shows a single U-shaped corner brace shared by the openings of multiple storage units.

In some embodiments, an assembled cabinet made of multiple storage units may have its front composed of the collective openings of these storage units. In this case, the U-shaped corner brace 300 may have its vertical reinforcement rod 320 extending beyond a single storage unit. In other words, the length of the vertical reinforcement rod 320 may be multiply of the length/width of a single storage unit, so that the U-shaped corner brace 300 may connect to the connectors around the collective openings of these storage units. When it's necessary to increase the single compartment volume of the assembled cabinet, as shown in FIG. 13, a single U-shaped corner brace 300 can be shared by the openings of multiple storage units.

Figure 6:
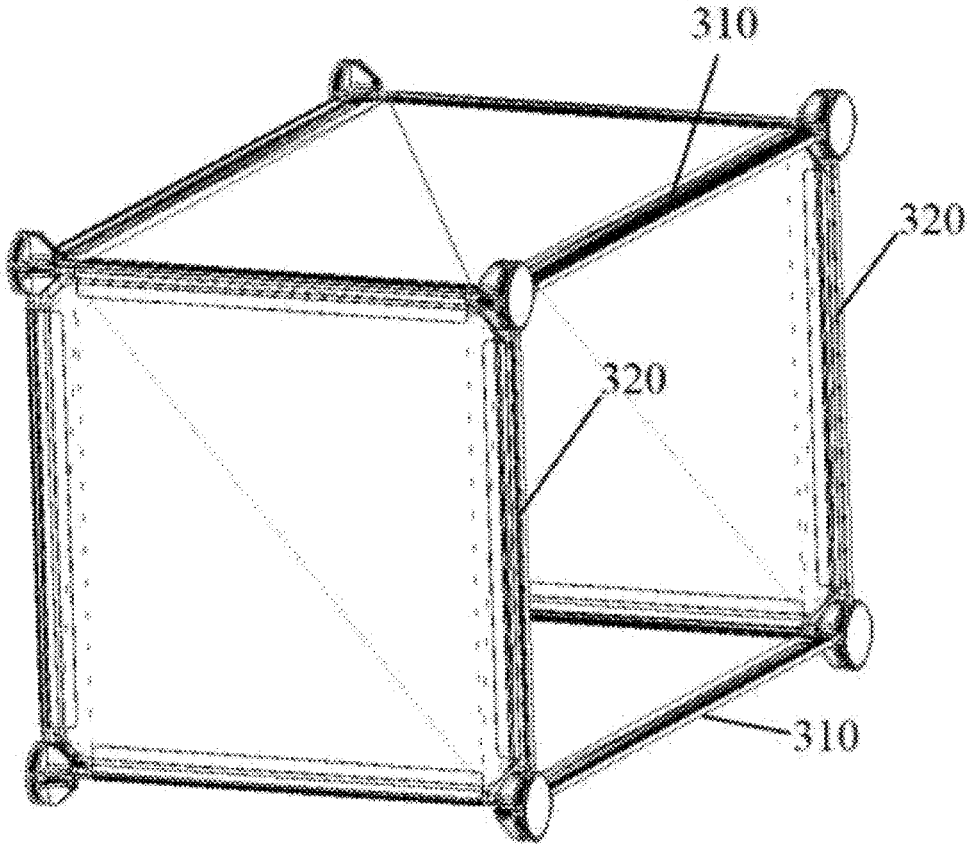
FIG. 6 shows a frame-shaped corner brace.

FIG. 6 shows a frame-shaped corner brace, according to certain embodiments of the present disclosure. In FIG. 6, the frame-shaped corner brace may have two horizontal reinforcement rods 310 and two vertical reinforcement rods 320, interconnected into a frame-shape. Each of the horizontal reinforcement rods 310 and vertical reinforcement rods 320 may have a length that is substantially equal to the height/width of the storage unit. Further, the frame-shaped corner brace can have four corners that can be inserted into four corresponding connector slots 210 of four adjacent connectors. As shown in FIG. 6, the frame-shaped corner brace may greatly enhance the strength of the front opening of the storage unit.

In some embodiments, when the front of an assembled cabinet composed of the collective openings of multiple storage units, the length of the horizontal reinforcement rod 310 and the vertical reinforcement rod 320 for a frame-shaped corner brace may be multiply of the length/width of a single storage unit, so that the frame-shaped corner brace may connect to the connectors around the collective openings of these storage units. Further, when a reinforcement rod 210 or 220 extending across multiple storage units, it may be blocked by one or more connectors that are located along the path of the reinforcement rod 210 or 220. In this case, the reinforcement rod 210 or 220 may adopt a non-straight design, and may be bent around the blocking connectors to avoid contacting these connectors.

Figure 8:
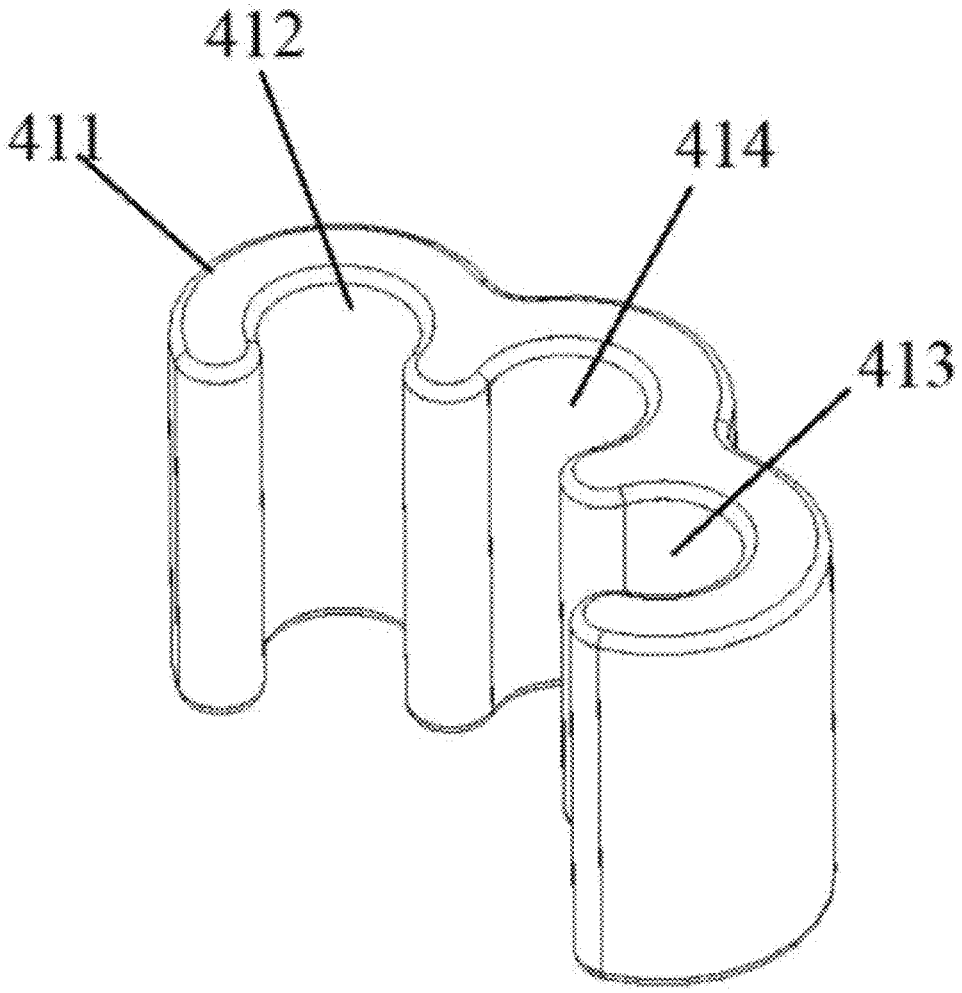
FIG. 8 shows a detail view of a door connector being installed onto a corner brace.

FIG. 8 shows a detail view of a door connector being installed onto a corner brace, according to certain embodiments of the present disclosure. In FIG. 8, the door connector 410 may include an elastic plate 411 equipped with a first buckle slot 412 for connection to the panel frame of a panel. The door connector 410 may have a second buckle slot 413 for connection to the hinge of a door 400. The elastic plate 411 possesses a certain level of elasticity, enabling it to function as a connector. Further, the door connector 410 may have a third buckle slot 414 positioned between the first buckle slot 412 and the second buckle slot 413 for connecting with a corner brace 300. Thus, this door connector 410 may allow a door assembly to be added onto a front opening of the storage unit/assembled cabinet.

Figure 7:
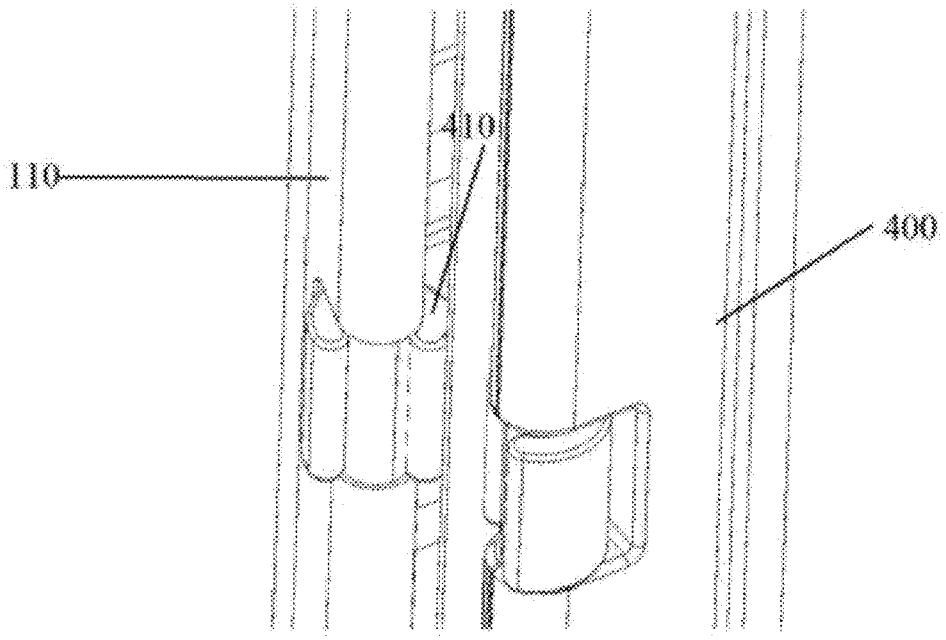
FIG. 7 shows a detail view of an installed door connector.

FIG. 7 shows a detail view of an installed door connector, according to certain embodiments of the present disclosure. In FIG. 7, a door 400 may be installed onto a panel frame 110 of a side panel next to the front opening of a storage unit. The first buckle slot 412 may be connected with the panel frame 110. The third buckle 414 may be connected to the horizontal or vertical enhancement rod of a L-shaped, U-shaped, or frame-shaped corner brace that is installed around the front opening of the storage unit. And the second buckle 413 may be installed onto a hinge of the door 400. Therefore, with the support of corner brace 300 and the door connector 410, a door 400 may be installed onto the front opening of the storage unit, thus improving the connection effectiveness of the whole assembled cabinet.

Figure 9:
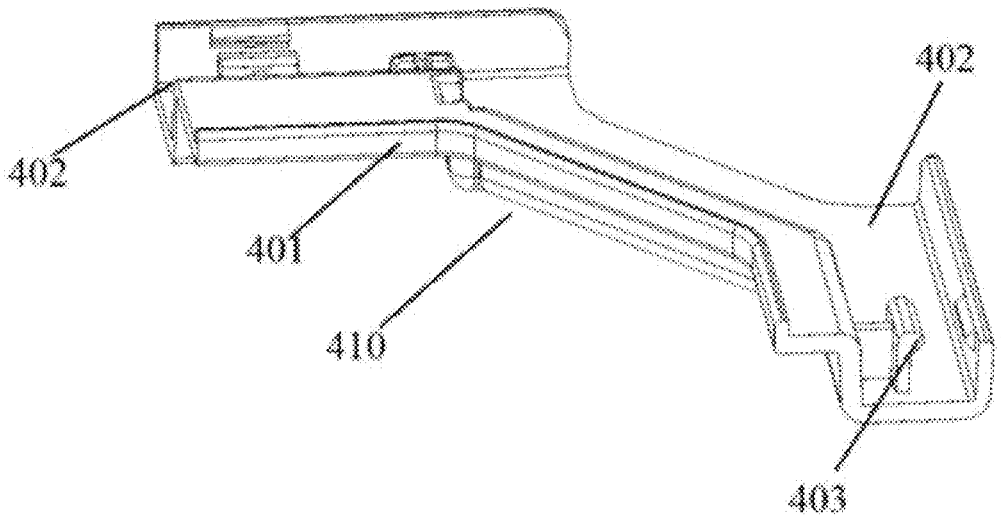
FIG. 9 shows a corner section of a door frame.

FIG. 9 shows a corner section of a door frame, according to certain embodiments of the present disclosure. In FIG. 9, the door frame 410 may be installed onto a L-shaped, U-shaped, or frame-shaped corner brace, and may be configured to support a door 400. Specifically, the door frame 410 may include a support plate 401 with horizontal and vertical fixed slots 402 that contain anti-detachment elastic hooks 403 to enhance fixation of the door 400. Specifically, the door frame 410 is designed as a mounting frame, which includes a first installation part for connecting with a corner brace 300, and a second installation part to be installed with a door 400.

In some embodiments, the horizontal and vertical fixed slots 402 of the door frame 410 may be used to install onto a panel frame or the rods of a corner brace. Specifically, the panel frame or rod may be snap into the horizontal and/or vertical fixed slots 402, and the anti-detachment elastic hooks 403 may prevent the panel frame/rod from easily slipping out. Such an approach allows the door frame to be installed into any part of the storage unit, as long as the door frame can be attached onto the panel frames of the panels in the storage unit. In other words, when being installed onto any panel of the storage unit, the door frame may act as a mounting frame that can provide stability and strength to the panel.

Figure 10:
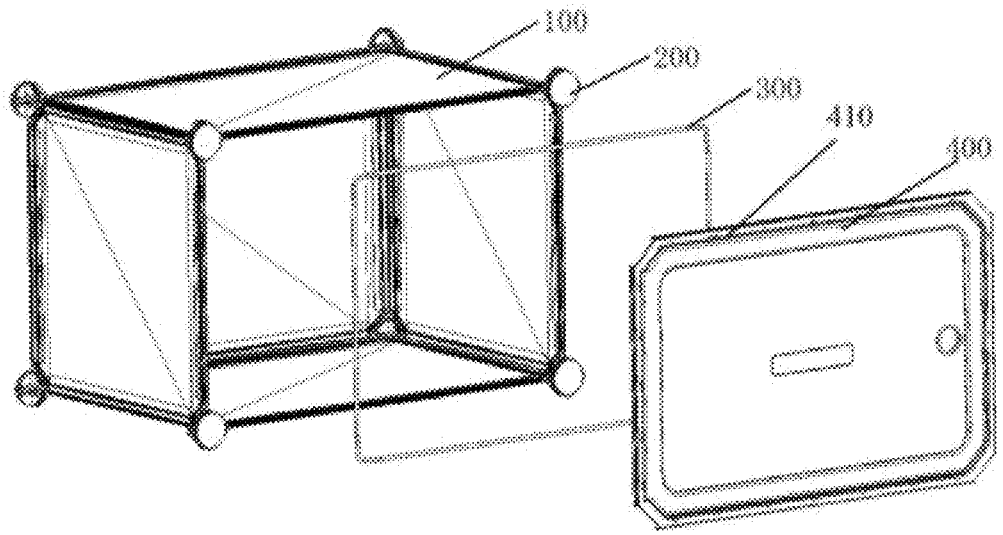
FIG. 10 shows a door panel configured to be installed onto a storage unit.

FIG. 10 shows a door panel configured to be installed onto a storage unit, according to certain embodiments of the present disclosure. In FIG. 10, a frame-shaped corner brace 300 may be installed onto the front opening of the storage unit. Alternatively, a L-shaped or U-shaped corner brace 300 may be installed onto the four connectors positioned at the four corners of the front opening. The door panel 400 may include a door frame 410 and a door 400. The four corners of the door frame 410 may be similar to the one shown in FIG. 9. And the door frame 410 may be installed onto the corner brace 300 by snapping the rods of the corner braces into the horizontal and/or vertical fixed slots 402.

Figure 11:
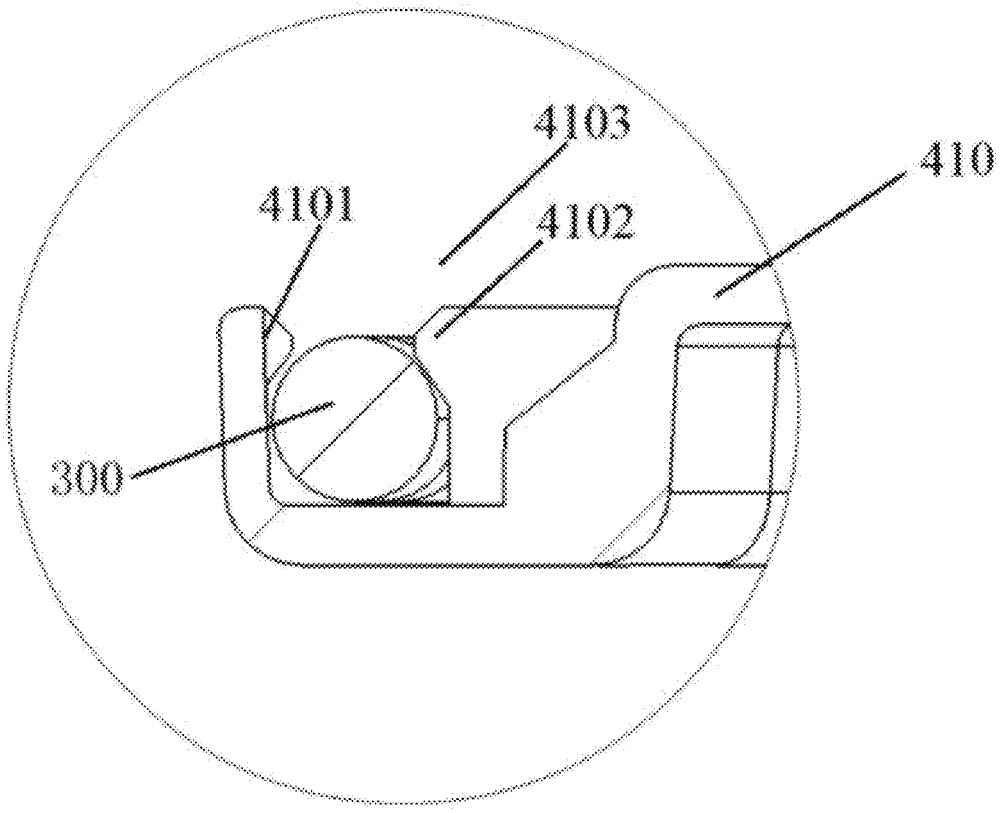
FIG. 11 shows a cross-sectional partial view of a door connector being installed with a panel or corner brace.

FIG. 11 shows a cross-sectional partial view of a door connector being installed with a panel or corner brace, according to certain embodiments of the present disclosure. In FIG. 11, the rod of a corner brace 300 may be installed into the horizontal or vertical fixed slot 402 of a door frame, and the corner brace 300 may be installed into the connectors located at the four corners of the front opening of a storage unit. Thus, the door frame can be connected to the storage unit via the corner braces 300.

In some embodiments, the fixed slot may be equipped with several fasteners arranged around its inner wall. The fasteners include oppositely positioned first snap block 4101 and second snap block 4102, which may form a clamping area 4103 between them. The clamping area 4103 allows the insertion and secure holding of the corner brace 300. Further, the door connector may be equipped with axle holes, and the pivots or hinges of the door may be inserted into the axle holes, so that the door may be rotated around the hinges/pivots for opening and closing.

Figure 12:
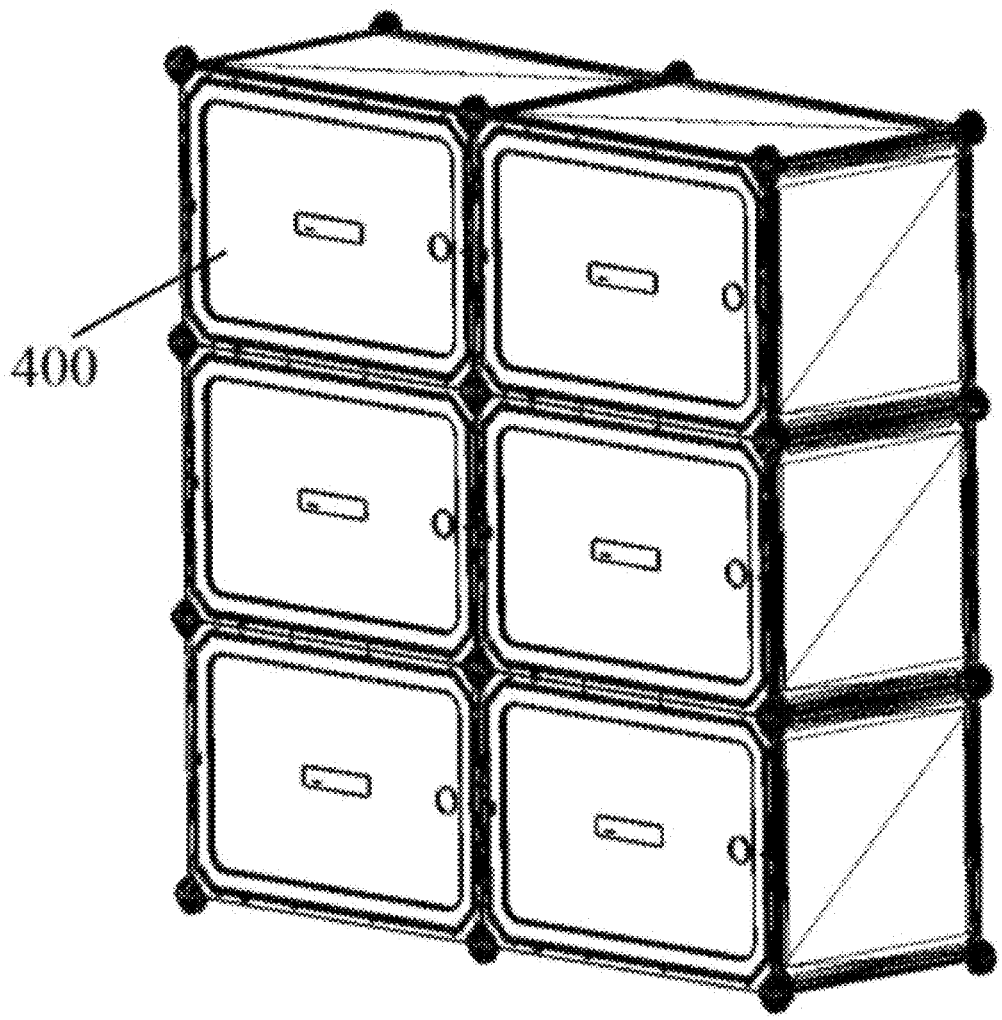
FIG. 12 shows an overview of an assembled cabinet with multiple storage units and doors.

FIG. 12 shows an overview of an assembled cabinet with multiple storage units and doors, according to certain embodiments of the present disclosure. In FIG. 12, each door 400 may have its door frame mounted onto a L-shaped, U-shaped, or frame-shaped corner brace (hidden behind the doors 400) installed around the front opening of a corresponding storage unit. The doors may enhance the stability to the overall structure of the assembled cabinet.

FIG. 13 shows a customized assembled cabinet, according to certain embodiments of the present disclosure. In FIG. 13, the assembled cabinet may have some of the storage units combined into larger storage area. For example, two adjacent storage units (e.g., one on top of another), may have a panel between them removed/uninstalled, so that these two adjacent storage units may be combined into a bigger storage unit. In this case, the removed panel was acting as the bottom of the top storage unit and the top of the bottom storage unit before being removed, and the opening of this bigger storage unit may be twice the size of an opening of a single storage unit.

In some embodiments, a U-shaped or frame-shaped corner brace 300 with twice the length of its vertical reinforcement rod may be installed around the opening of the bigger storage unit. In this case, the corner brace 300 may provide extra strength, especially in the vertical direction, to compensate for the lacking of a middle panel in the storage unit. Alternatively, the bigger storage unit may be formed by removing a side panel between the adjacent storage units, and more than two storage units may be connected into a bigger storage unit with the removal of corresponding panels in between these storage units.

Figure 14:
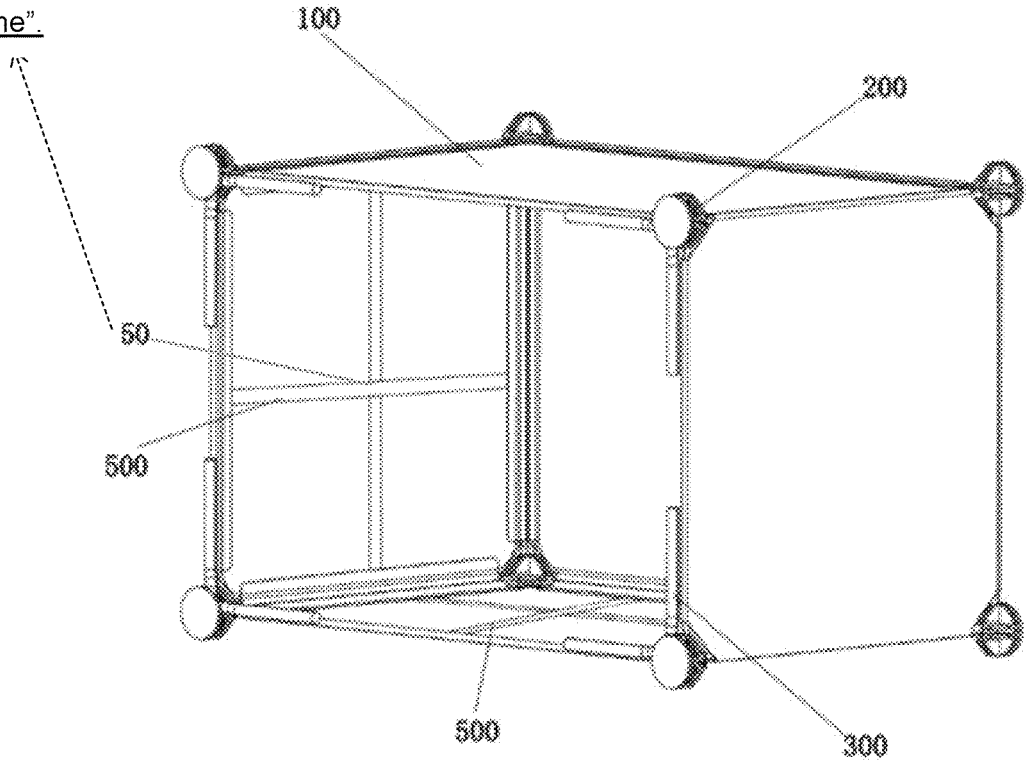
FIG. 14 shows a mount frame being installed inside of a storage unit, all according to certain embodiments of the present disclosure.

FIG. 14 shows a mount frame 50 being installed inside of a storage unit, according to certain embodiments of the present disclosure. In FIG. 14, a mount frame 50, similar to a door frame of a door, may be installed onto any panel of the storage unit. For example, the mount frame 50 may be installed on the inner surface of the left-side panel, by having the horizontal and vertical fixed slots of the mount frame 50 being attached to the panel frame of the left-side panel. Such an approach allows the left-side panel to be strengthened. Likewise, the mount frame 50 may also be installed on the panel frame of the right-side, back-side panel, top-side panel, or bottom-side panel, to provide supports to these panels.

In some embodiments, the mount frame 50 may further include enhancement bars 500 placed within the mount frame 50. Specifically, two ends of each enhancement bar may be attached to the mount frame 50, and the enhancement bars 500 may be in-parallel, cross-sectioned, or in any arrangement that can provide extra supporting strengths. Thus, one or more mount frames can be installed onto the interior of the assembled cabinet.

The above embodiments are only used to illustrate technical solutions of the disclosure and not to limit them. Although the present application has been described with reference to preferred embodiments, various modifications may be made thereto and components thereof may be replaced with equivalents without departing from the scope of the present application. Especially, as long as there is no structural conflict, various technical features mentioned in various embodiments can be combined together in any manner. The present application is not limited to the specific embodiments disclosed herein, instead, it can include all technical solutions that fall within the scope of the claims.

The invention claimed is:

1. A storage unit for an assembled cabinet, comprising:

multiple panels and connectors interconnected to form an inner space and an opening, wherein each of the panels includes a panel frame and a panel sheet that covers the panel frame, with panel corners of the panel frame not being covered by the panel sheet, each of the connectors has multiple panel corners corresponding to panel corners, and adjacent connector slots are oriented perpendicularly to each other, corner braces, each of which is inserted into a corresponding connector located around the opening of the storage unit, wherein the corner braces are installed into available connector slots of the corresponding connectors, a door for covering the opening; and a door connector for connecting the door with a corresponding panel and a corresponding corner brace next to the opening, wherein the door connector further comprises a support plate having horizontal and vertical fixed slots located on the support plate, with anti-detachment elastic hooks placed within the fixed slots.

2. The storage unit as set forth in claim 1, wherein the corner brace comprises a first horizontal reinforcement rod and a first vertical reinforcement rod intersecting at a corner of the corner brace, wherein when the corner brace is installed in the corresponding connector, the first horizontal reinforcement rod and the first vertical reinforcement rod at least partially in contact with one of the panels adjacent to the corresponding connector.

3. The storage unit as set forth in claim 2, wherein the first horizontal reinforcement rod and the first vertical reinforcement rod intersecting in an L-shape, with the intersection being the corner of the corner brace.

4. The storage unit as set forth in claim 2, wherein the corner brace further comprises a second horizontal reinforcement rod intersecting with the first vertical reinforcement rod to form a U-shape, with the intersections of the first and second horizontal reinforcement rods with the first vertical reinforcement rod forming two corners for installing into two corresponding connectors that are adjacent to each other around the opening of the storage unit.

5. The storage unit as set forth in claim 2, wherein the corner brace further comprises a second horizontal reinforcement rod and a second vertical reinforcement rod, wherein the first and second horizontal reinforcement rods intersect with the first and second vertical reinforcement rods to form a frame-shape with four corners, and the four corners are configured to be installed into four corresponding connectors that are adjacent to each other around the opening of the storage unit.

6. The storage unit as set forth in claim 1, wherein the door connector includes a first buckle slot for connecting with a panel frame of the corresponding panel, a second buckle slot for connection to a hinge of the door, and a third buckle slot situated between the first and second buckle slots for connecting to the corresponding corner brace.

7. The storage unit as set forth in claim 1, wherein the door connector includes a door frame with a first installation part for connection with the corner brace and a second installation part for door installation;

the first installation part is equipped with fasteners arranged around the mounting frame for connecting with a corresponding corner brace, the second installation part includes an axle hole for connecting with a pivot on the door, and the fasteners include oppositely positioned first and second slot blocks which create a clamping area between them.

8. The storage unit as set forth in claim 1, further comprising a mount frame for installing onto a corresponding panel.

9. The storage unit as set forth in claim 8, wherein the mount frame is installed onto the internal surface of the corresponding panel, and the corresponding panel is located on the top, bottom, left, right, or back of the storage unit.

10. The storage unit as set forth in claim 8, wherein the mount frame comprises enhancement bars.

11. An assembled cabinet, comprising:

multiple storage units, wherein for a storage unit selected from the multiple storage units, the storage unit comprises multiple panels and connectors interconnected to form an inner space and an opening, wherein each of the panels includes a panel frame and a panel sheet that covers the panel frame, with panel corners of the panel frame not being covered by the panel sheet, each of the connectors has multiple panel corners corresponding to panel corners, and adjacent connector slots are oriented perpendicularly to each other, and corner braces, each of which is inserted into a corresponding connector located around the opening of the storage unit, wherein the corner braces are installed into available connector slots of the corresponding connectors, a door for covering the opening; and a door connector for connecting the door with a corresponding panel and a corresponding corner brace next to the opening, wherein the door connector further comprises a support plate having horizontal and vertical fixed slots located on the support plate, with anti-detachment elastic hooks placed within the fixed slots.

12. The assembled cabinet as set forth in claim 11, wherein an extended opening is formed by openings of two or more storage units, and a U-shaped corner brace selected from the corner braces is inserted into two corresponding connectors of the two or more storage units.

13. The assembled cabinet as set forth in claim 11, wherein an extended opening is formed by openings of two or more storage units, and a frame-shaped corner brace selected from the corner braces is inserted into four corresponding connectors of the two or more storage units.

14. The assembled cabinet as set forth in claim 11, wherein the multiple storage units are horizontally and vertically arranged in the assembled cabinet.

* * * * *